United States Patent [19]

Dahl et al.

[11] 4,180,216

[45] Dec. 25, 1979

[54] WINDER WITH HORIZONTAL RIDER ROLL ADJUSTMENT

[75] Inventors: Carl B. Dahl, Rockton, Ill.; Jere W. Crouse, Beloit, Wis.

[73] Assignee: Beloit Corporation, Beloit, Wis.

[21] Appl. No.: 895,598

[22] Filed: Apr. 12, 1978

[51] Int. Cl.[2] ..... B65H 17/12

[52] U.S. Cl. ..... 242/66

[58] Field of Search ..... 242/66, 65, 67.1 R, 242/67.2–67.5, 75.1, 75.2

[56] References Cited

U.S. PATENT DOCUMENTS

| | | | |
|---|---|---|---|
| 2,276,980 | 3/1942 | Jacobi | 242/66 X |
| 3,064,915 | 11/1962 | Hornstein et al. | 242/66 |
| 3,599,889 | 8/1971 | Pfeiffer | 242/66 |
| 3,837,593 | 9/1974 | Dorfel | 242/66 |
| 3,858,820 | 1/1975 | Crouse | 242/66 |
| 3,902,677 | 9/1975 | Wolf | 242/66 |
| 3,990,648 | 11/1976 | Justus et al. | 242/66 |
| 4,047,676 | 9/1977 | Dahl et al. | 242/66 |

OTHER PUBLICATIONS

Paper Trade Journal, Dec. 11, 1967, pp. 48–51, by David A. Daly, "How paper rolls on a winder generate vibration and bouncing."

*Primary Examiner*—Harvey C. Hornsby
*Assistant Examiner*—John M. Jillions
*Attorney, Agent, or Firm*—Hill, Van Santen, Steadman, Chiara & Simpson

[57] ABSTRACT

A method and mechanism for winding a roll from a continuous traveling web including first and second parallel winder drums supporting the wound roll and one or more rider rolls on top of the roll being wound with the rider roll circumferential location being changed during the winding of the roll to compensate for the changing spring constant of the roll being wound, and in one form applying a force with a second rider roll and in another form with a third rider roll with the rolls being changed in position relative to the roll being wound independent of each other.

7 Claims, 7 Drawing Figures

Fig. 1
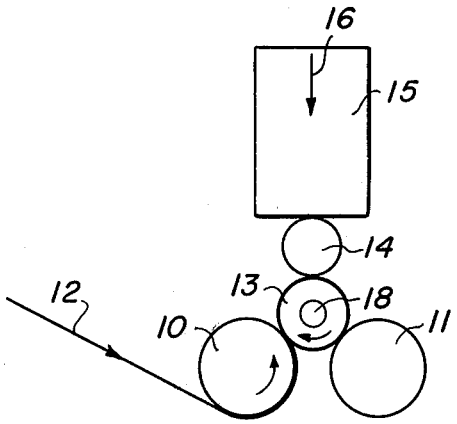
Fig. 2
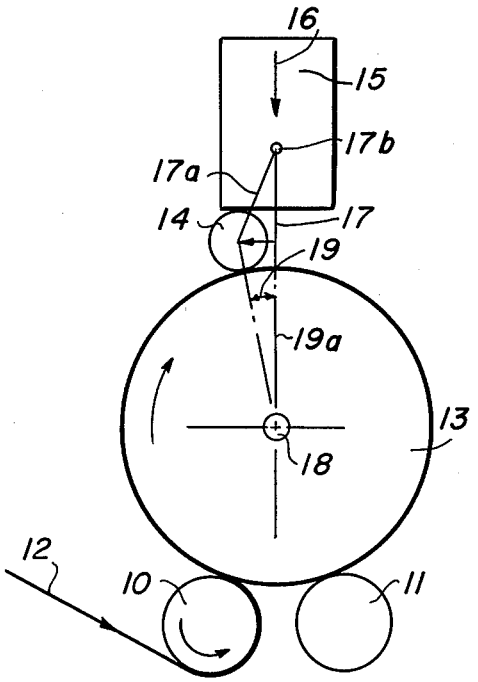
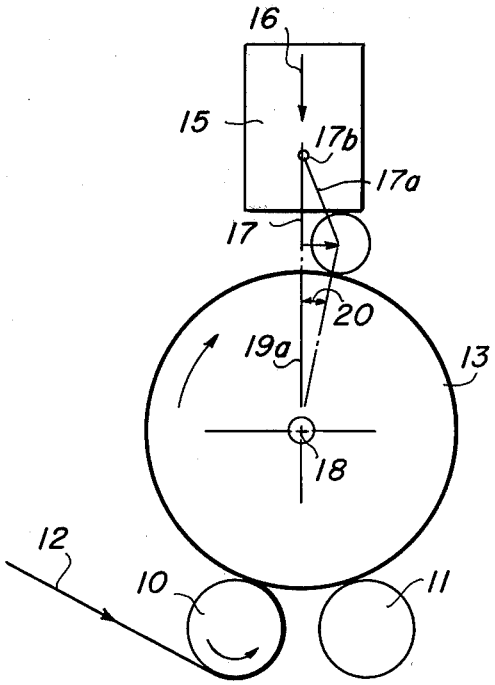
Fig. 3

WINDER WITH HORIZONTAL RIDER ROLL ADJUSTMENT

BACKGROUND OF THE INVENTION

The invention relates to improvements in winders for winding a roll from a continuous traveling web, and more particularly to improvements in paper web winders such as used on paper making machines or used in paper web converting operations.

In high speed winding wherein a roll is wound from a web of paper onto a core, the web will travel at speeds of 4,000 to 6,000 feet per minute, and it is imperative that the winding progress uniformly so as to maintain a constant tension of the web on the roll and insure that the roll is uniform. With changes in size of the roll as its size increases, the effects of the supporting and driving mechanism change so that control becomes difficult. One of the phenomena which occurs is vibration or bouncing of the roll, and this is a term used to describe two common modes of vibration. These modes are radial which is a repetitive radial motion, sometimes called buzzing, against a winding drum which affects wound roll speed and quality. Another adverse effect is rocking, which is an arc-like repetitive angular motion, sometimes known as thumping, which occurs with respect to the winding drum, and this is a less frequent problem than the radial motion. The bouncing or vibration of the paper roll in a double drum winder wherein the roll is supported on two parallel drums is a cause for reduced production during the winding operation. The paper maker observes the problem as audible buzzing or a rocking thumping back and forth on the winding drums. He will attempt to adjust tension on the web or pressure of the rider roll on top of the wound roll to control the bouncing generally with little success. It then becomes necessary to reduce speed until the buzzing or thumping is controlled. This vibration or bouncing not only causes production difficulties requiring slowing of winding, but it also creates maintenance problems. As to the mechanism itself, looseness of parts will occur, foundation cracks and excessive wear and fatigue of the metal of parts can occur. This operation with accompanying bouncing can also be extremely dangerous to personnel in the vicinity of the winder because of the high kinetic energy of a roll rotating from 4,000 to 6,000 feet per minute when the roll weighs several thousand pounds. The disturbance in the roll continues to be generated around the circumference of the roll until it closes to form a repeating cycle. Thus, the bouncing becomes a harmonic of the wound roll rotation. The initial disturbance may be caused by many factors including uneven paper surface, machine direction basis weight variations, caliper variations, eccentric starts, variations in paper or paper to steel frictional characteristics, glue, unwinder drums and winder chevrons. Once this disturbance occurs, the next disturbances which follow are related to the energy available or the deformable nature, diameter and roll characteristics (friction) of the wound roll.

Adjusting tension or rider roll pressure is in effect an attempt at changing the deformable nature of the paper roll. It is difficult to have much control over the problem by making these adjustments. A poorly wound roll is generally the only result.

Reducing the rewinding roll speed generally reduces the tendency for the initial disturbance to deform the roll, and it reduces energy available to sustain the vibration. It is a means of stopping winder bounce, but does not result in being able to maintain production speeds.

The two drum winder actually presents a mass elastic system which can be envisioned as consisting of a rotatable mass having deformable springs on fixed drums. That is, the reaction force between the supporting drums and the roll is resilient in nature having a spring constant. With this, the natural frequencies can be calculated. These natural frequencies change with change in roll size. The rider roll engaging the top of the wound roll provides another force relationship which interacts with a spring constant. Thus, the resiliency of the roll engaged at three points of support, i.e., the two supporting drums, and the rider roll, provides an unstable unit.

Efforts to control bouncing have included adding a vibration absorber to the rider roll, but this has not proven to fully solve the problem.

It is accordingly an object of the present invention to provide an improved paper web winder which is capable of high speed continuous winding operation without bouncing and without the deleterious winding effects caused by such bouncing.

A further object of the invention is to provide an improved two drum winder which is capable of compensating for a change in springiness factor of the wound roll during winding.

Other objects, advantages and features, as well as equivalent structures and methods which are intended to be covered herein, will become more apparent with the teaching of the principles of the invention in connection with the disclosure of the preferred embodiments in the specification, claims and drawings, in which:

DRAWINGS

FIG. 1 is a schematic end elevational view of a two drum winder constructed and operating in accordance with the principles of the present invention showing the position of the parts at the beginning of the winding operation;

FIG. 2 is a schematic showing the arrangement of FIG. 1 showing the position of the parts as the size of the roll builds up;

FIG. 3 is another schematic view of the mechanism of FIGS. 1 and 2 showing a variation in the relationship of position of parts;

DESCRIPTION

Figure 4:
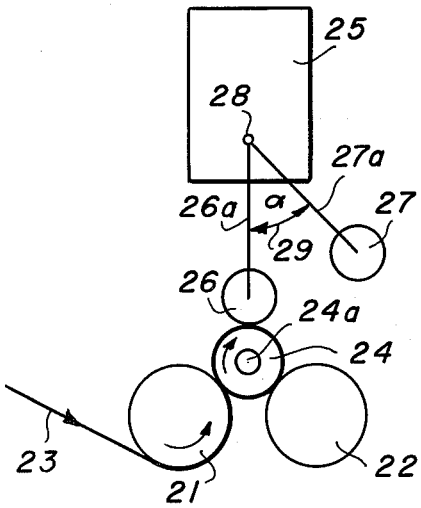
FIG. 4 is an end schematic elevational view of another form of the invention showing the position of parts in the beginning of a wound roll.

As illustrated in FIG. 1, a winder is provided having first and second parallel winder drums 10 and 11 which extend horizontally and support a roll 13 being wound on the drums. The web being wound 12 is supplied over the surface of the drum 10 and feeds onto the roll 13.

A rider roll 14 rests on top of the roll being wound supported on a beam 15 which is loaded mechanically by a mechanism shown schematically by the arrowed line 16. Thus, as the roll is started winding, it is wound onto a central core 18 supported by the rotating drums which are driven in rotation and the rider roll 14 is centrally located over the central axis of the core 18. As the wound roll builds up, the position of the rider roll is changed either in the manner shown in FIG. 2 or FIG. 3 to compensate for the bouncing.

The rider roll is supported on suitable mechanism such as a swing arm 17*a* mounted on a shaft 17*b*. The shaft 17*b* on the beam can be rotated to change the position of the rider roll 17 relative to the roll being wound. Thus, by changing the position of the rider roll 14 from the position shown in FIG. 1 where it is directly vertical over the core axis 18, to the position of FIG. 2 where it makes an angle 19 with the vertical line 19*a* directly over the core, the angle of application of the force of the rider roll is changed. In a preferred arrangement, the beam 16 remains at the same location and the mechanism supporting the rider roll functions to change the position of the rider roll circumferentially.

In the arrangement of FIG. 3, the swing arm 17*a* which supports the rider roll on the beam, is moved in the other direction so that the rider roll makes the angle 20 with the vertical line 19*a* over the wound roll axis 18.

Figure 5:
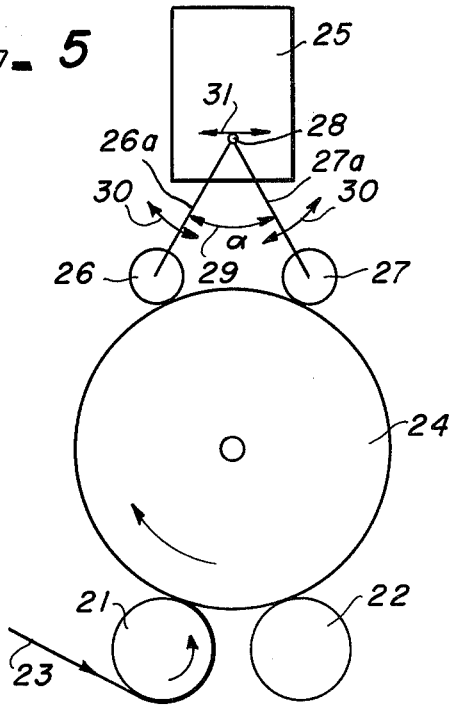
FIG. 5 is an end schematic elevational view of the mechanism of FIG. 4 showing the position of parts as the size of the wound roll builds up.

FIGS. 4 and 5 show another arrangement wherein two rider rolls 26 and 27 are provided. In the construction of these Figures, two horizontal parallel winding drums 21 and 22 are provided with the supplied web 23 passing over the drum 21 to be wound on a wound roll 24.

At the beginning of the winding operation, as shown in FIG. 4, the first rider roll 26 is positioned directly over the axis of the core 24*a* of the roll being wound. The rider roll 26 is supported on an arm 26*a* on a shaft 28 on an overhead beam 25. The beam is arranged to apply downward pressure to the rider roll 26. The rider rolls 26 and 27 are shown separated by an angle alpha at 29.

As the wound roll 24 increases in size, the two rider rolls 26 and 27 are brought down into contact with the periphery of the roll 24 being wound. This is done by rotating the supporting shaft 28 in the direction indicated by the arrowed lines 30. In addition to the rider rolls 26 and 27 being positionable so that either one of them is in engagement with the roll being wound, they are movable so as to be positioned with both being in engagement with the circumference of the roll being wound. Further, they are individually adjustable primarily by being able to be spread apart to increase the angle alpha at 29, as shown in FIG. 5. Thus, the rider rolls can be positioned further apart on the circumference of the roll being wound as its size increases. This may be provided by any suitable mechanism, and for example, the supporting shaft 28 may be a coaxial shaft with one of the shafts being connected to the arm 26*a* for the rider roll 26, and the other being connected to an arm 27*a* for the roll 27. With this control, while both rider rolls are preferably pressed against the roll being wound with the same pressure, they can be individually controlled so that one may be pressed with a greater force against the roll being wound and the other with a lesser force. This is done by power means, such as gears on the shafts 28 driven by pinions, and the power means is shown schematically by the arrowed lines 30. Also, the position of the support 28 for the rolls can be changed as indicated by the double arrowed line 31 so that the rider rolls 26 and 27 can be shifted to the left or right along the circumference of the roll being wound. A mechanism for accomplishing this will be apparent to those skilled in the art such as by providing a horizontal track on the support beam 25 with a threaded shaft and follower nut to change the position of the support for the rider rolls. The rider rolls also may be individually supported so that either can be shifted laterally in either direction along the circumference of the roll being wound, independently of each other.

Figure 6:
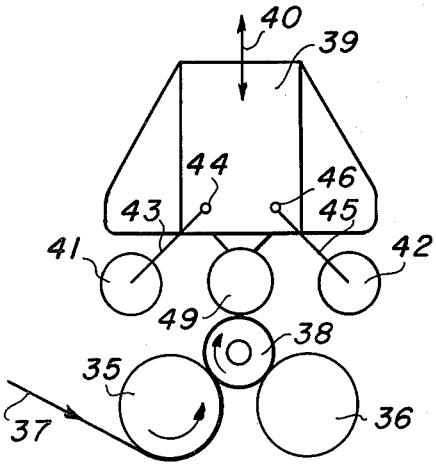
FIG. 6 is a schematic showing of an end elevational view of a two drum winder showing another form of the invention.
Figure 7:
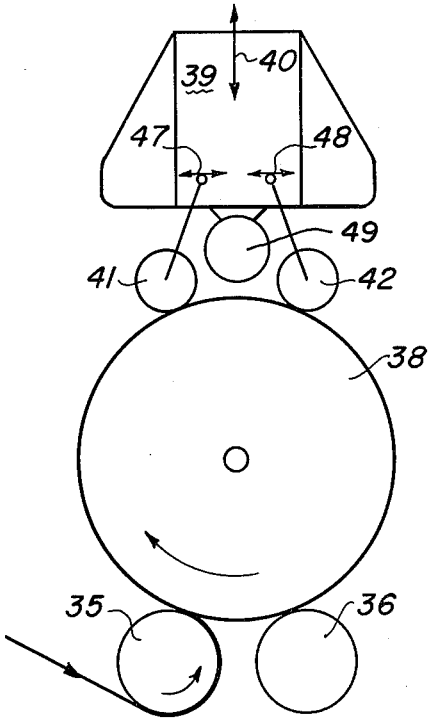
FIG. 7 is another view of the mechanism of FIG. 6 showing the relationship of parts as the size of the wound roll builds up.

In the arrangement shown in FIGS. 6 and 7, a third rider roll 49 is provided. In the structure shown, support winding drums 35 and 36 are provided with a web 37 fed over one of the drums to be wound into a roll 38. An overhead beam 39 is provided carrying a first rider roll 49 thereon. At the beginning of the winding operation, the first rider roll 49 which is centrally located applies a vertical force to the roll. As the size of the roll builds up, second and third rider rolls 41 and 42 are brought down against the surface of the roll being wound. For this purpose, these rolls are respectively supported on swing arms 43 and 45 carried on shafts 44 and 46 on the beam 39. The beam is vertically movable by a mechanism indicated schematically by the double arrowed line 40. When the two rider rolls 41 and 42 are brought down against the surface of the roll being wound, the beam is raised to raise the first rider roll 49 off of the circumference of the roll being wound so that the second and third rider rolls 41 and 42 provide the sole vertical downward force against the roll being wound.

Each of the second and third rider rolls may be supported on the beam so that their circumferential position can be individually and independently changed along the surface of the roll being wound. For this purpose, the support shafts 44 and 46 may be positioned in horizontal slides indicated schematically by the double arrowed lines 47 and 48.

In a preferred arrangement, the central rider roll 49 is first maintained in contact with the roll being wound, and its vertical force is gradually augmented by the second and third rider rolls 41 and 42 being brought down against the surface of the roll being wound. The first roll 49 is then lifted off of the surface of the roll being wound. It is possible to shift the position of either or both of the rider rolls 41 and 42 along the circumference of the roll being wound.

The arrangements shown in each of the drawings will be programmed in accordance with the amount of vertical force applied to the roll being wound, and the direction which this force is applied by changing the position of the rider rolls on the roll being wound in order to avoid bounce. The bounce which occurs will vary in accordance with various operational factors including the speed of winding, the type of paper being wound, the tension at which it is wound and other factors aforementioned herein so that the application of the rider roll force and the location at which it is applied must be variable to eliminate the vibration. Thus, with change in spring constant as the wound roll increases in size, the change in effects of this can be fully compensated for.

It has been found that the springiness factors $K_1$ for static and $K_2$ for dynamic conditions are proportional to the internal tangential and radial compressive stresses. Nip load and mass contribute to determine the initial stress structure of a wound roll of paper in a two drum winder. This is the springiness factors which are considered in the vibratory modes of the wound roll in the two drum winder. The vibratory modes can be changed by changing the boundary conditions, i.e., the rider positions and force, which causes a change in the angle of application from the rider roll and the nip loading caused by the rider roll.

As an example of use with the structure of FIGS. 1 and 2, winding of a roll 13 is begun with the rider roll 14 centered over the axis of the core. This relative position of the rider roll will be maintained until bounce of the roll being wound occurs either in the form of buzzing vibration or rocking thumping. This phenomena can be predetermined from past experience and will be programmed into the machine at the weight or size of the wound roll where the bouncing can first occur. At that point, the rider roll is programmed to be gradually shifted in a lateral direction as the wound roll increases in size, for example, the shifting can be a linear relationship with the shift being in amounts of a given angular change, or a given distance change for a given increase in weight or diameter of the wound roll. The programmed change in location of the rider roll can be determined mechanically by a cam and a follower structure which will shift the rider roll laterally as a function of its rise in height, or the relationship may be determined electrically by a computer arrangement which is programmed to control the mechanism for shifting the roll as a function of increase in wound roll size.

We claim as our invention:

1. In a winder for winding a continuous traveling web, the combination comprising:

first and second cylindrical winder drums rotatable in the same direction on horizontal parallel axes for supporting a roll being wound thereon;

a rider roll initially positioned centrally above the winder drums for engaging the surface of the wound roll and applying a generally downwardly directed force thereto;

a stationary beam means for supporting the rider roll above said roll to be wound at a fixed distance from said beam means and applying the downward force;

and means for continuously changing the location of said rider roll circumferentially relative to the wound roll axis during winding to compensate for the changing spring constant of the wound roll and reducing the vibration thereof, said location changing means being supported on said beam and maintaining the rider roll centrally located with respect to the drums at the beginning of the winding operation and moving the rider roll laterally relative to the beam along the surface of the wound roll to a final position at an angle from the center of the wound roll as the size of the wound roll increases.

2. In a winder for winding a continuous traveling web, the combination comprising:

first and second cylindrical winder drums rotatable in the same direction on horizontal parallel axes for supporting a roll being wound thereon;

a first rider roll rotatable on a first pair of support arms and positioned above the winder drums for engaging the surface of the wound roll for applying a generally downwardly directed force;

a second rider roll rotatable on a second pair of support arms and positioned above the winder drums for engaging the surface of the wound roll and applying a generally downwardly directed force;

and beam means for supporting the first and second rider rolls having a pivot mounted thereon to which the first and second pairs of support arms are attached for selective independent rotation about said pivot for applying the downward force.

3. In a winder for winding a continuous traveling web constructed in accordance with claim 2:

including means for independently selectively changing the radial force applied by each of said first and second rider rolls to the wound roll during winding for controlling the vibration thereof to compensate for changing spring constant of the wound roll.

4. In a winder for winding a continuous traveling web constructed in accordance with claim 2:

including a third rider roll centrally located between the first and second rider rolls engaging the outer surface of the wound roll and applying a downward force to the wound roll.

5. In a winder for winding a continuous traveling web constructed in accordance with claim 4:

including means connected to the beam means and to each of said first, second and third rider rolls and operative to cause the centrally located rider roll to first engage the outer surface of the wound roll during the beginning of winding and thereafter to cause the second and third rider rolls to engage the wound roll and the first roll to move to disengagement from the wound roll.

6. A method of winding a roll from a continuous traveling web comprising the steps:

supporting the roll being wound on first and second cylindrical winder drums arranged on horizontal parallel axes;

applying a downwardly directed force to the wound roll by engaging the circumference with a rider roll as it is being wound;

changing the circumferential location of the rider roll during the winding operation compensating for change in spring constant of the roll being wound;

applying a second downwardly directed force with a second rider roll and changing the location of the rolls during the winding operation; and changing the position of the two rolls independent of each other and moving them to different circumferential locations during the winding operation .

7. A method of winding a roll from a continuous traveling web comprising the steps:

supporting the roll being wound on first and second cylindrical winder drums arranged on horizontal parallel axes;

applying a downwardly directed force to the wound roll by engaging the circumference with a rider roll as it is being wound;

applying a second downwardly directed force with a second rider roll engaging the outer surface of the roll being wound; and applying a third downward force to the roll with a third rider roll, said forces being applied by applying the force of the first roll alone during starting winding and thereafter removing the first roll and applying forces with the second and third rolls against the roll being wound.

* * * * *